US008419491B2

(12) United States Patent
Tanaka et al.

(10) Patent No.: US 8,419,491 B2
(45) Date of Patent: Apr. 16, 2013

(54) METHOD FOR MANUFACTURING A SPARK PLUG FOR PREVENTING DEFORMATION CAUSED BY CUTTING A CENTER ELECTRODE

(75) Inventors: Tomoyuki Tanaka, Nagoya (JP); Takashi Tamada, Nagoya (JP)

(73) Assignee: NGK Spark Plug Co., Ltd., Nagoya (JP)

( * ) Notice: Subject to any disclaimer, the term of this patent is extended or adjusted under 35 U.S.C. 154(b) by 0 days.

(21) Appl. No.: 13/360,086

(22) Filed: Jan. 27, 2012

(65) Prior Publication Data

US 2012/0208424 A1 Aug. 16, 2012

(30) Foreign Application Priority Data

Feb. 5, 2011 (JP) ..... 2011-23425

(51) Int. Cl.
*H01T 21/02* (2006.01)

(52) U.S. Cl.
USPC ..... 445/7; 83/13

(58) Field of Classification Search ..... 445/7; 83/13
See application file for complete search history.

(56) References Cited

U.S. PATENT DOCUMENTS

| | | | |
|---|---|---|---|
| 5,556,315 | A | 9/1996 | Kagawa |
| 5,574,329 | A | 11/1996 | Kagawa |
| 6,707,237 | B2 | 3/2004 | Teramura et al. |
| 7,772,751 | B2 | 8/2010 | Suzuki et al. |
| 2003/0071552 | A1 | 4/2003 | Teramura et al. |
| 2009/0302733 | A1* | 12/2009 | Nunome et al. ..... 313/141 |
| 2011/0316408 | A1 | 12/2011 | Suzuki |

FOREIGN PATENT DOCUMENTS

| | | | |
|---|---|---|---|
| JP | 63-022212 | A | 1/1988 |
| JP | 06-218619 | A | 8/1994 |
| JP | 07-22154 | A | 1/1995 |
| JP | 8-236263 | A | 9/1996 |
| JP | 11-10436 | A | 1/1999 |
| JP | 2001-307858 | A | 11/2001 |
| JP | 2007-280942 | A | 10/2007 |
| JP | 2010-212097 | A | 9/2010 |

OTHER PUBLICATIONS

Office Action mailed Jan. 22, 2013 for the corresponding Japanese Patent Application No. 2011-023425.

* cited by examiner

*Primary Examiner* — Joseph L Williams
(74) *Attorney, Agent, or Firm* — Leason Ellis LLP

(57) ABSTRACT

When a movable blade cuts a distal end portion of a ground electrode member and is pulled back along a cut surface formed at a distal end of the ground electrode member, the distal end portion may move in the pull-back direction of the movable blade due to friction generated between the movable blade and the cut surface. This movement could cause deflective deformation of the ground electrode member. In order to restrain such movement, a support part is provided on the movable blade via a spring located near the cut surface. During the pull back step, the support part presses and supports the portion of the cut ground electrode member near the distal end thereof. Therefore, even when friction is generated when the movable blade is pulled back, the ground electrode member does not undergo deflective deformation.

15 Claims, 14 Drawing Sheets

METHOD FOR MANUFACTURING A SPARK PLUG FOR PREVENTING DEFORMATION CAUSED BY CUTTING A CENTER ELECTRODE

CROSS-REFERENCE TO RELATED PATENT APPLICATIONS

This application claims the benefit of Japanese Patent Application No. 2011-23425, filed Feb. 5, 2011, which is incorporated by reference herein.

FIELD OF THE INVENTION

The present invention relates to a method for manufacturing a spark plug used for an engine.

BACKGROUND OF THE INVENTION

FIG. 13 shows a conventional spark plug 101 which includes a rodlike insulator 11 having an axial hole 10 extending along the direction of an axis G; a center electrode 21 disposed in a front end portion of the axial hole 10; a tubular metallic shell 31 (having a bore extending along the direction of the axis G) which surrounds the circumference of the rodlike insulator 11; and a ground electrode (side electrode) 41 whose one end (proximal end) 42 is joined to the front end 33 of the metallic shell 31 and whose other end (distal end) 43 is bent to face the distal end 23 of the center electrode 21. Notably, reference numeral 35 denotes a screw for attachment to an engine.

Such a spark plug 101 has been manufactured as follows (Japanese Patent Application Laid-Open (kokai) No. 2007-280942). That is, its manufacturing process is as follows. A rod-shaped ground electrode member (a ground electrode intermediate before being bent to form the ground electrode 41), which extends straight along the axis G, is welded at its distal end to the front end 33 of the metallic shell 31. Subsequently, the rodlike insulator holding the center electrode, etc. assembled into the axial hole thereof is assembled into the metallic shell. After that, in order to obtain the spark plug 101 shown in FIG. 13, the ground electrode member is bent such that its distal end 43 faces the distal end 23 of the center electrode 21 with a predetermined spark gap formed therebetween.

Incidentally, in recent years, there has been growing demand for a spark plug whose spark gap has very high dimensional accuracy. Meanwhile, the rodlike insulator 11, fixedly disposed within the metallic shell 31, has a dimensional error of itself and a positional error in the front-rear direction (the direction of the axis G) in relation to the metallic shell 31 stemming from an assembly error. The center electrode 21, fixedly disposed within the rodlike insulator 11, also has a dimensional error of itself and an unavoidable positional error in the front-rear direction stemming from an assembly error. Therefore, the axial distance between the position of the distal end of the unbent ground electrode member, which extends from the front end 33 of the metallic shell 31, and the position of the distal end of the center electrode involves an error even if the length accuracy of the unbent ground electrode member (component) itself is maintained high. That is, even in the case where the ground electrode member which is accurate in length is accurately welded to the front end of the metallic shell, if such a ground electrode member is merely bent, difficulty is encountered in forming a spark gap between the distal end of the ground electrode and the distal end of the center electrode such that the spark gap has a desired high level of dimensional accuracy.

In order to overcome such a problem, the following method has been employed recently (Japanese Patent Application Laid-Open (kokai) No. H08-236263). A ground electrode member (component) before being welded (before being bent) 40 is formed to have a length slightly longer than its designed length, and is welded to the front end 33 of the metallic shell 31 as shown in section A of FIG. 14. The rodlike insulator 11 holding the center electrode 21 is assembled into the metallic shell 31 so as to obtain an intermediate 100 of the spark plug. The amount of projection (in the axial direction) of the unbent ground electrode member 40 in relation to the distal end 23 of the center electrode 21 is rendered slightly greater than the designed amount, and a distal end portion 43*b* of the ground electrode member 40 is cut before it is bent, whereby the accuracy of the projection amount (dimension) is secured. In this state, the distal end portion 43*b* of the ground electrode member 40 at the front end 33 of the metallic shell 31 is cut by a slight length (e.g., 0.5 mm to 3 mm) such that the projection dimension of the ground electrode member 40 becomes a desired dimension, whereby the accuracy of the projection dimension is secured. After that, the ground electrode member 40 is bent. Notably, in recent years, demand has arisen for narrowing the ground electrode so as to improve spark performance, and, therefore, there has been performed an operation of cutting and removing opposite sides of the distal end of the ground electrode member 40 such that the distal end has a tapered shape (chamfered shape), rather than merely cutting the distal end portion 43*b* of the ground electrode member 40 such that the ground electrode member 40 becomes shorter.

Meanwhile, such cutting is effected by means of shearing (work) from the viewpoint of the machining (manufacturing) efficiency. In such shearing work, as shown in section A of FIG. 14, the metallic shell 31 having the ground electrode member 40 welded to its front end 33 is fixed, and a portion of the ground electrode member 40 near the distal end thereof is supported by a stationary blade 50 for cutting, for example, from the outer side (the side opposite the axis G of the metallic shell 31). In this state, as shown in section B of FIG. 14, a cutting blade (movable blade) 60 is fed from the inner side (the side toward the axis G of the metallic shell 31) so as to cut and remove the distal end portion 43*b*. Notably, such a feed direction of the movable blade 60 is employed so as to cope with the shape of the front end of the spark plug, and to prevent generation of cutting burrs on the spark gap side.

Problems to be Solved by the Invention

However, such a conventional cutting operation has a problem in that, after the cutting operation, the ground electrode member 40 defectively deforms toward the axis G (see sections C and D of FIG. 14). This deformation occurs by way of the following mechanism. When the movable blade 60 is pulled back after the cutting operation as shown in sections C and D of FIG. 14, friction acts on the cut surface (cut end surface) 45 at the distal end of the ground electrode member 40, and a distal end portion of the ground electrode member 40, including the cut surface 45, moves together with the movable blade 60. Meanwhile, in the case where the deformed ground electrode member 40 is bent so as to form the ground electrode 41 in the next step to thereby form a spark gap between its distal end 43 and the distal end 23 of the center electrode 21, the accuracy of the spark gap deteriorates. In order to solve such a problem, conventionally, a step of rectifying or correcting (eliminating) such deflective deformation has been performed before the bending work. As described above, conventionally, such a correction step has been needed so as to form the ground electrode 41 which can form an accurate spark gap. Therefore, its work efficiency (efficiency of the bending work) has been low, which increases the manufacturing cost of the spark plug 101.

Notably, the details of the mechanism by which the distal end portion 43*b* of the ground electrode member 40 causes deflective deformation after the cutting operation is as follows. The ground electrode member 40 is a bar member having a very small rectangular transverse cross section whose height is about 1 mm and whose width is about 2 mm. Before the movable blade 60 is retracted after completion of the cutting operation, there is produced a force under which the cut surface 45 and the cutting surface of the movable blade 60 are pressed against each other. When the movable blade 60 is retracted or pulled back, due to the friction produced between the cut surface 45 and the cutting surface of the movable blade 60, a large lateral force acts on the distal end of the ground electrode member 40, to thereby bend the ground electrode member 40. That is, since the ground electrode member 40 projects from the front end 33 of the metallic shell 31 in a cantilever fashion, as a result of retraction of the movable blade 60 after the cutting operation, the ground electrode member 40 easily causes deflective deformation because of the force acting on its free end, where the cut surface 45 is present. Such a problem has become more likely to occur because of the recent demand for downsizing of the ground electrode 41, and a measure for solving such a problem has been demanded.

The present invention has been accomplished in view of such a problem, and its object is to prevent occurrence of the above-described deflective deformation which would otherwise occur during manufacture of a spark plug; that is, when a distal end portion of a ground electrode member welded to the front end of a metallic shell is cut and removed by means of shearing (work).

SUMMARY OF THE INVENTION

Means for Solving the Problems

A first invention is a method for manufacturing a spark plug which includes a center electrode, a metallic shell having a bore extending in a direction of an axis, and a ground electrode disposed at a front end of the metallic shell and formed from a ground electrode member, the method being characterized in that a step of forming the ground electrode includes a cutting step of cutting off a distal end portion of the ground electrode member provided on the metallic shell through shearing work performed through use of a movable blade, whereby a cut surface is formed at the distal end of the ground electrode member; and a support part is disposed in the vicinity of the cut surface in order to prevent the distal end of the ground electrode member from moving in a direction in which the movable blade is pulled back after the movable blade has cut the distal end portion in the cutting step, which movement of the distal end would otherwise occur due to friction generated between the movable blade and the cut surface at the distal end of the ground electrode member when the movable blade is pulled back along the cut surface.

A second invention is a method for manufacturing a spark plug according to the first invention, wherein the support part supports a surface of a portion of the ground electrode member near the cut surface at the distal end thereof, the surface facing the axis of the metallic shell. A third invention is a method for manufacturing a spark plug according to the first invention, wherein the support part nips a portion of the ground electrode member near the cut surface at the distal end thereof via opposite side surfaces of the portion perpendicular to the cut surface and the surface of the portion facing the axis of the metallic shell.

A fourth invention is a method for manufacturing a spark plug which includes a center electrode, a metallic shell having a bore extending in a direction of an axis, and a ground electrode disposed at a front end of the metallic shell and formed from a ground electrode member, the method being characterized in that a step of forming the ground electrode includes a cutting step of cutting off a distal end portion of the ground electrode member provided on the metallic shell through shearing work performed through use of a movable blade, whereby a cut surface is formed at the distal end of the ground electrode member; and after having cut the distal end portion in the cutting step, the movable blade is moved in a direction away from the cut surface.

A fifth invention is a method for manufacturing a spark plug according to the fourth invention, wherein the shearing wok is performed by use of a stationary blade along with the movable blade in a state in which the stationary blade is in contact with a contact surface of the ground electrode member; and after the cutting step, in place of moving the movable blade in the direction away from the cut surface and then pulling back the movable blade, there are performed the steps of moving the stationary blade in a direction away from the contact surface of the ground electrode member, moving the movable blade together with the stationary blade in the direction away from the cut surface, and pulling back the movable blade.

A sixth invention is a method for manufacturing a spark plug according to the fourth or fifth invention, wherein a distance by which the movable blade is moved in the direction away from the cut surface is equal to or greater than a clearance between the stationary blade and the movable blade before the movable blade and the stationary blade move. A seventh invention is a method for manufacturing a spark plug according to any one of the first through sixth inventions wherein, the cutting step is a length reducing step of cutting the distal end portion of the ground electrode member through the shearing work such that the length of the ground electrode member becomes shorter.

An eighth invention is a method for manufacturing a spark plug according to any one of the first through sixth inventions, wherein the cutting step is an oblique cutting step of obliquely cutting opposite side surfaces of the distal end portion of the ground electrode member through the shearing work such that the distal end portion is tapped off as viewed from a surface of the distal end portion which is to face the center electrode when the ground electrode member is bent.

A ninth invention is a method for manufacturing a spark plug according to any one of the third to eighth inventions, wherein a noble metal tip is joined to a portion of the ground electrode member near the distal end thereof, the portion forming a gap in cooperation with a distal end of the center electrode when the ground electrode member is bent. A tenth invention is a method for manufacturing a spark plug according to any one of the third to eighth inventions, wherein a protrusion is formed on a portion of the ground electrode member near the distal end thereof, the portion forming a gap in cooperation with a distal end of the center electrode when the ground electrode member is bent.

Effects of the Inventions

In the first to third inventions, even in the case where friction is generated when the movable blade is pulled back along the cut surface at the distal end of the ground electrode member after the cutting step, since the support part prevents the distal end of the ground electrode member from moving together with the movable bald in the pull-back direction of the movable blade, deflective deformation (deformation caused by deflection of the ground electrode member), which occurs when a conventional manufacturing method is employed, can be prevented. In the present invention, the support part may be an elastic member such as a spring (coil spring). Alternatively, the distal end of a piston rod of a fluid cylinder (a pneumatic cylinder or a hydraulic cylinder) may be used as the support part. Alternatively, the support part may be one which is positioned by known fixing means such as lock means using a cam, or one which nips the ground electrode member.

In the case where a spring is used for the support part in the second invention, since the support part can be attached to the movable blade, the structure for disposing the support part can be simplified. Also, in the case where the support part nips the ground electrode member via the opposite side surfaces thereof as in the third invention, even when a mark or scratch is formed as a result of the nipping operation, the mark or scratch is formed on the opposite side surfaces. Therefore, the influence of the mark or scratch on spark performance can be reduced. In addition, the method according to the third invention can cope with the case where a noble metal tip is joined to a potion of the ground electrode member near the distal end thereof, or a protrusion is formed on such a portion as in the case of the ninth and tenth inventions.

In the fourth to sixth inventions, deflection deformation, which otherwise occur after the cutting step, is prevented by preventing friction from being generated when the movable blade is pulled back along the cut surface at the distal end of the ground electrode member after the ground electrode member is cut. Accordingly, generation of deflective deformation can be prevented without the necessity of providing the support part as in the case of the first through third inventions. In the fourth invention, after the cutting step, the movable blade is moved in a direction away from the cut surface. However, as in the case of the fifth invention, not only the movable blade but also the stationary blade may be moved in the direction away from the cut surface after the cutting step. As defined in the sixth invention, the distance of such movement is preferably set to a distance equal to or greater than a clearance between the stationary blade and the movable blade as measured before they are moved.

Notably, the term "shearing" used in relation to the present invention encompasses the case where the distal end portion of the ground electrode member is cut such that the ground electrode member becomes shorter as in the case of the seventh invention, and the case where the opposite sides of the distal end portion of the ground electrode member are obliquely cut such that the distal end portion has a tapered shape as in the case of the eighth invention. Also, in the case where a noble metal tip is joined to the ground electrode member (the ninth invention) or a protrusion is formed on the ground electrode member (the tenth invention), ignition performance can be enhanced further.

BRIEF DESCRIPTION OF THE DRAWINGS

These and other features and advantages of the present invention will become more readily appreciated when considered in connection with the following detailed description and appended drawings, wherein like designations denote like elements in the various views, and wherein.

DETAILED DESCRIPTION OF THE INVENTION

Mode for Carrying out the Invention

Figure 1:
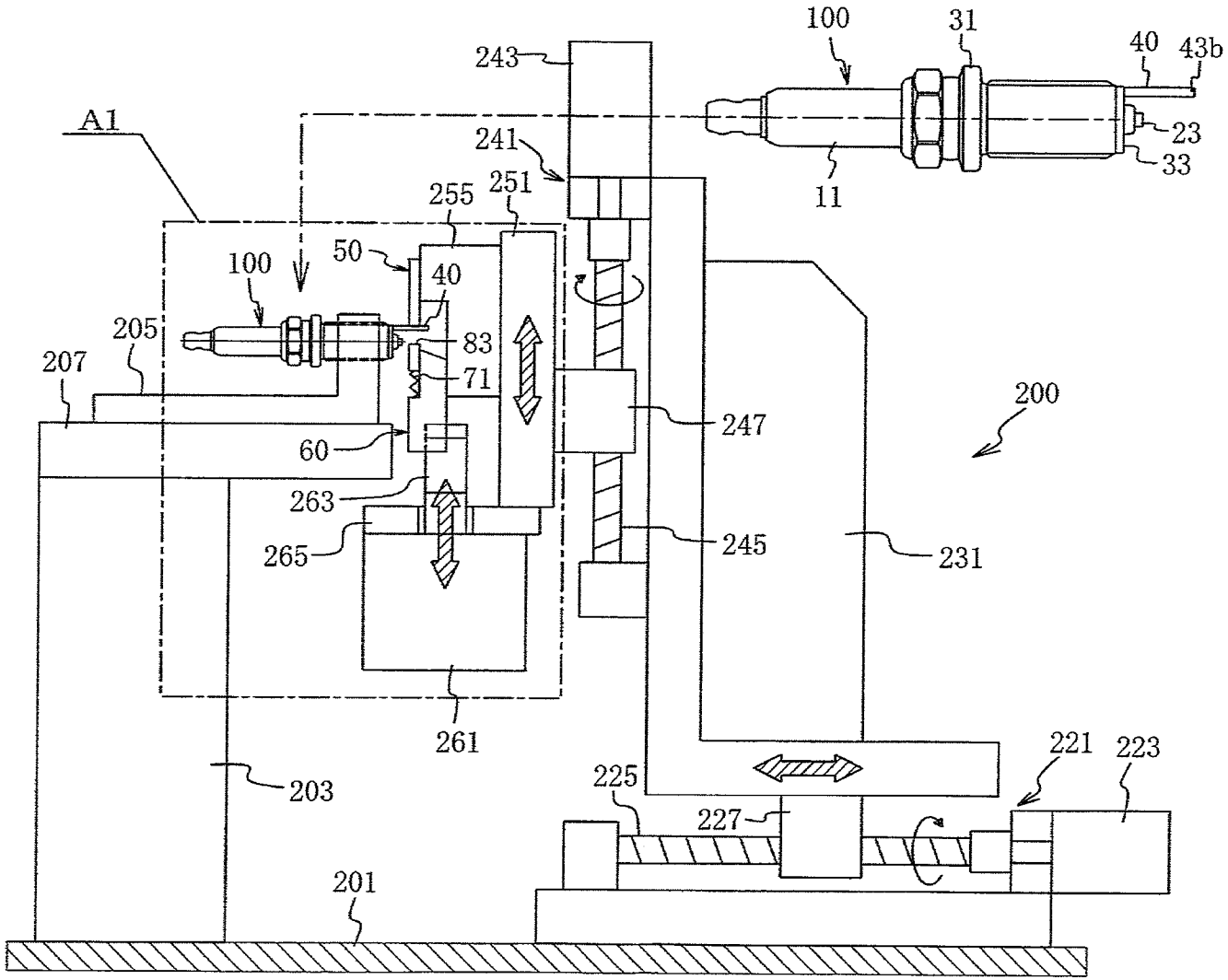
FIG. 1 is a schematic front view of a cutting apparatus used for a method for manufacturing a spark plug in which the present invention is embodied.

An embodiment (first embodiment) of the present invention will next be described with reference to FIGS. 1 to 3. In FIG. 1, reference numeral 100 denotes an intermediate of a spark plug (hereinafter referred to as a spark plug intermediate, or simply as an intermediate), which is manufactured by a method according to the present embodiment. The intermediate 100 includes a rodlike insulator 11 holding a center electrode 21 disposed inside (within a hole thereof); and a tubular metallic shell 31 into which the insulator 11 is assembled. The metallic shell 31 has a ground electrode member 40 projectingly extending from its front end 33 in (approximately) parallel to the axis G of the metallic shell 31. This ground electrode member 40 has a barlike shape, and has a rectangular transverse cross section. The proximal end 42 of the ground electrode member 40 is welded to the front end 33 of the metallic shell 31 such that, when the metallic shell 31 is viewed from the front end 33 side, the transverse cross section of the ground electrode member 40 becomes symmetric with respect to one diametric direction. In a first step, a distal end portion of the ground electrode member 40 of this intermediate 100 is cut and removed (shearing work) by a cutting apparatus 200 shown in FIG. 1, which uses a stationary blade 50 and a movable blade 60. Thus, the length of the ground electrode member 40 is adjusted to a desired length. After this operation (after the cutting step), the ground electrode member 40 is bent in a subsequent step such that a spark gap of a predetermined size is formed between the ground electrode member 40 and the distal end 23 of the center electrode 21. Thus, the spark plug is completed. Next, the first embodiment; specifically, an embodiment of the cutting step of cutting the distal end portion 43*b* of the ground electrode member 40 provided at the front end 33 of the metallic shell 31 of the intermediate 100, will be described in detail, along with the cutting apparatus 200.

First, the cutting apparatus 200 used in the present embodiment will be described with reference to FIG. 1, which schematically shows the structure of the apparatus, and FIG. 2, which is an enlarged view of a portion of FIG. 1 including the intermediate 100. This cutting apparatus 200 includes a workpiece table 203 disposed on a base 201 to be located on the left side thereof, and a workpiece support 207 is disposed on the workpiece table 203. The workpiece support 207 has a jig 205, which supports and clamps (fixes) the intermediate (workpiece) 100; specifically, a portion (screw portion) of the metallic shell 31 near the front end 33 thereof, such that the ground electrode member 40 of the metallic shell 31 is located on the right side, and becomes horizontal (at the uppermost position). Meanwhile, a column 231 is disposed on the base 201 to be located on the right side thereof, via a horizontal position adjustment mechanism 221, which can move the column 231 in the left-right direction (a horizontal direction along the axis G of the metallic shell 31). A tool slide 251 is provided on the column 231 to be located on the left side thereof, via a vertical position adjustment mechanism 241, which can move the tool slide 251 in the vertical direction.

A block 255, to which the stationary blade 50 is mounted, is fixed to the left side surface of the tool slide 251 to be located at the upper side thereof. The stationary blade 50 is fixed to the left side surface of the block 255 by means of a fixation bolt (not shown). The stationary blade 50 has a cutting edge at the lower end (on the right side of the lower end). An air cylinder (or a hydraulic cylinder; hereinafter, simply referred to as the cylinder in some cases) 261 is fixed to the lower end of the tool slide 251 via a front flange 265, through which a piston rod 263 of the air cylinder 261 projects upward. The air cylinder 261 can move the piston rod 263 vertically toward the stationary blade 50 and can retract the piston rod 263. The movable blade 60, which extends upward and has a cutting edge at the left side of the upper end thereof, is attached to the distal end of the piston rod 263. When the movable blade 60 is moved upward, its cutting edge and the cutting edge of the stationary blade 50 cooperatively shear the distal end portion 43*b* of the ground electrode member 40 fixed to the front end 33 of the metallic shell 31 of the intermediate 100, in a direction orthogonal to the direction in which the ground electrode member 40 projects from the metallic shell 31. As described above, in the present embodiment, the cutting operation is set such that the movable blade 60 is moved upward by driving the air cylinder 261 so as to feed the movable blade 60 from the side toward the axis G of the metallic shell 31, to thereby shear the distal end portion 43*b* of the ground electrode member 40 in cooperation with the stationary blade 50. Notably, a predetermined clearance (shearing clearance) in the horizontal direction is provided between the cutting edges of the two blades.

The horizontal position adjustment mechanism 221 is a servo mechanism including a servomotor 223. By means of driving and controlling the motor 223, the column 231 is moved horizontally via a drive screw block 227, which is in screw engagement with a screw shaft 225 rotated by the motor 223. Similarly, the vertical position adjustment mechanism 241 is a servo mechanism including a servomotor 243. By means of driving and controlling the motor 243, the tool slide 251 is moved vertically via a drive screw block 247, which is in screw engagement with a screw shaft 245 rotated by the motor 243.

Figure 2:
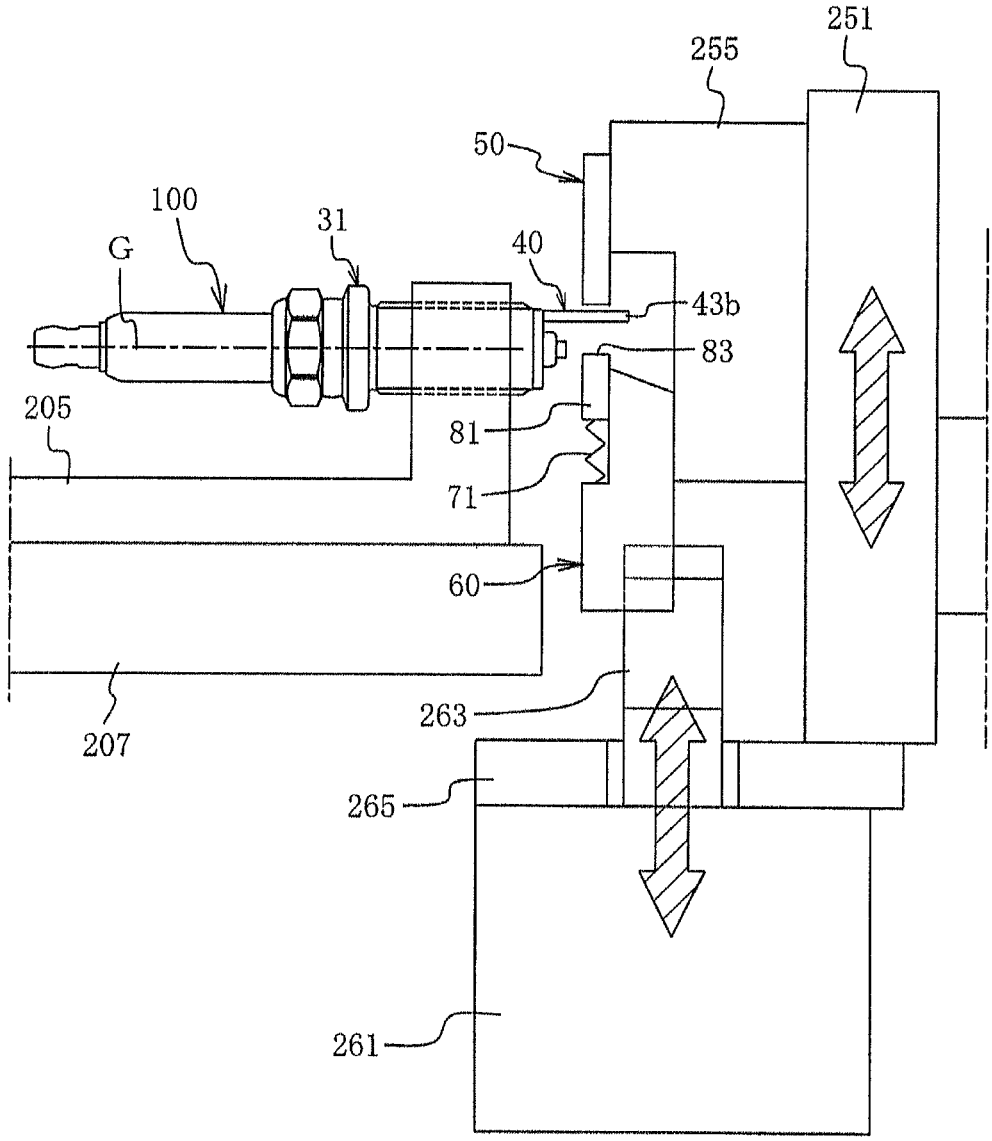
FIG. 2 is an enlarged view of a portion of FIG. 1 indicated by A1.
Figure 3:
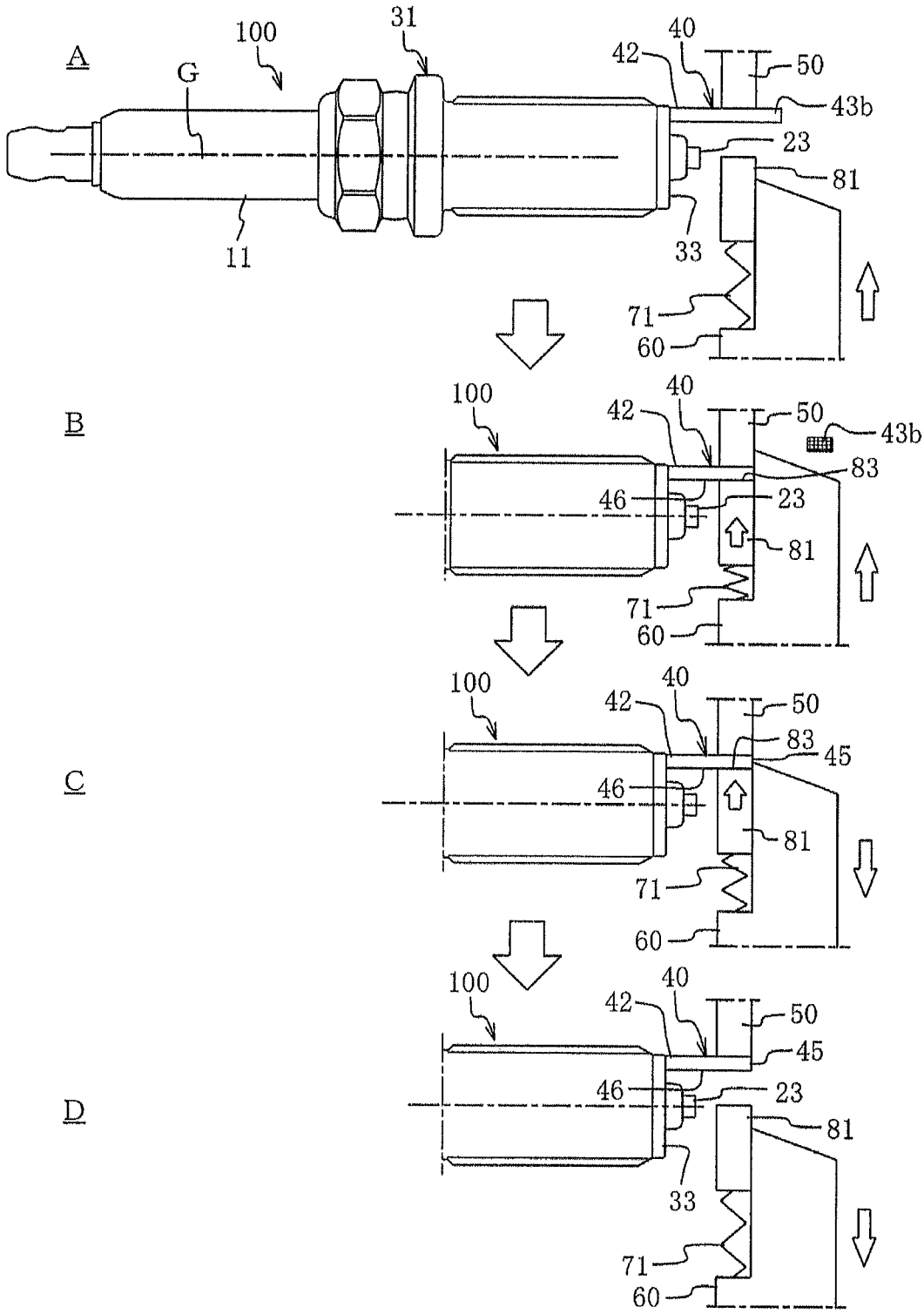
FIG. 3 is an explanatory views showing steps in a first embodiment of the method for manufacturing a spark plug through use of the cutting apparatus of FIG. 1.

In the present embodiment, a spring (e.g., a coil spring) 71, which can be compressed in the vertical direction, is disposed along the left side of the movable blade 60 in FIGS. 1 and 2. A support block 81 is fixed to the upper end (free end) of the spring 71 so as to support a surface of a portion of the ground electrode member 40 near the distal end thereof, at a position in the vicinity of the expected cutting position (the expected position of the cut surface), the surface facing the axis G of the metallic shell 31. In the present embodiment, an upper surface of the support block 81 serves as a support part 83. At the beginning of the step (cutting step) of shearing the distal end portion 43*b* of the ground electrode member 40 by moving the movable blade 60 upward through drive of the cylinder 261, the support block 81 comes into contact with the ground electrode member 40, and slides, as the spring 71 is compressed along the left side surface of the movable blade 60, and supports the ground electrode member 40. When the spring 71 is in a free state, the support block 81 projects upward from the tip of the cutting edge (blade tip) of the movable blade 60. The spring 71, which holds the support block 81, has a spring force (spring constant) determined as follows. When the movable blade 60 is moved downward so as to pull back the same to the original position after the shearing (cutting) operation, friction (frictional resistance) is generated between the movable blade 60 and the cut surface at the distal end of the cut ground electrode member 40 until the cutting edge of the movable blade 60 separates from the cut surface; i.e., when the movable blade 60 is pulled back along the cut surface at the distal end of the cut ground electrode member 40. Accordingly, the distal end of the ground electrode member 40 may move in the pull-back direction of the movable blade 60. The spring force of the spring 71 is determined such that the spring 71 can prevent such movement of the distal end of the ground electrode member 40, which movement would otherwise occur because of the friction generated between the movable blade 60 and the cut surface. Notably, before the cutting operation is performed by moving the movable blade 60 upward, the support block 81 is held at a position separated from the ground electrode member 40.

As described above, the intermediate 100 is positioned on the jig 205 on the workpiece support table 207 of the cutting apparatus 200 such that the ground electrode member 40 is located at the uppermost position and becomes horizontal. The jig 205 supports and fixes a portion of the metallic shell 31 near the front end 33 thereof. Next, in order to bring the cutting edge of the stationary blade 50 (cutting position) to a predetermined position with respect to the horizontal direction, the column 231 and the tool slide 251 are moved by driving the horizontal position adjustment mechanism 221, whereby the position of the tool slide 251 is adjusted. Notably, the horizontal position of the cutting edge of the stationary blade 50 may be set as follows. The position of the distal end of the center electrode 21 is detected, and a predetermined position which is shifted from the distal end by a predetermined distance in the projecting direction of the ground electrode member 40 is set as the horizontal position of the cutting edge of the stationary blade 50. Moreover, through drive of the vertical position adjustment mechanism 241, the tool slide 251 is positioned such that the cutting edge of the stationary blade 50 fixed to the tool slide 251 comes into contact with the outer side surface of the ground electrode member 40 (see section A of FIG. 3). Next, as shown in section B of FIG. 3, the movable blade 60 is moved upward by driving the air cylinder 261 upon completion of the positioning of the stationary blade 50, whereby the movable blade 60 is fed into the ground electrode member 40 from a surface 46 located on the side toward the axis G of the metallic shell 31. Thus, the distal end portion 43*b* of the ground electrode member 40 is cut and removed through shearing. As shown in sections C and D of FIG. 3, after the shearing operation (after the distal end portion 43*b* is cut and removed such that the length of the ground electrode member 40 becomes shorter), the cylinder 261 is driven in reverse so as to retract the movable blade 60 to the original position. When necessary, the stationary blade 50 is separated from the cut surface by moving the tool slide 251 upward through drive of the vertical position adjustment mechanism 241. The intermediate 100 whose ground electrode member 40 has been cut is taken out from the jig 205, whereby the machining of the intermediate 100 is completed.

In the present embodiment, when the movable blade 60 is moved upward so as to perform shearing, before its cutting edge reaches the ground electrode member 40 (before the shearing operation starts), the support part (upper surface) 83 of the support block 81 comes into elastic contact or pressure contact with a portion of the inward-facing surface of the ground electrode member 40 near the cut surface 45. In this state in which that portion of the inward-facing surface is supported by the support part 83, the shearing operation is performed. In a step of pulling back (retracting) the movable blade 60 after completion of the shearing operation, as shown in sections C and D of FIG. 3, the spring 71 causes the support part 83 of the support block 81 to elastically press the surface (facing the axis G side) of the ground electrode member 40 in the upward direction by means of the above-mentioned spring force, until the movable blade 60 separates from the cut surface 45 of the ground electrode member 40. Therefore, the distal end of the ground electrode member 40 is prevented from moving in the pull-back direction of the movable blade 60 (toward the axis G of the metallic shell 31), which movement would otherwise occur due to friction (friction resistance) generated between the movable blade 60 and the cut surface when the movable blade 60 is pulled back along the cut surface 45 at the distal end of the ground electrode member 40 after the distal end portion 43*b* of the ground electrode member 40 is cut. After having undergone such a cutting step, the ground electrode member 40 of the spark plug intermediate 100 has a desired length without having deflective deformation.

Accordingly, such an intermediate 100 can be transferred to a next stage, without transferring it to a conventionally employed correction stage where deformation of the ground electrode member is corrected. In the next stage, the ground electrode member 40 is bent so as to form a ground electrode which can form a spark gap of desired accuracy. After that, the intermediate 100 undergoes necessary steps, whereby a desired spark plug is obtained. Notably, in the present embodiment, the ground electrode member 40 is supported by the support block 81, which is provided at the distal end of the movable blade 60 via the spring 71 provided thereon. Therefore, drive means for independently advancing and retracting the support block 81 is not required. Accordingly, the structure of the support block 81, which forms the support part 83, can be simplified.

Notably, instead of the structure including the spring 71 and the support block 81, a different structure may be used as the support part 83. Specifically, separately from the cylinder for moving the movable blade 60, an additional cylinder is provided so as to support a portion of the ground electrode member 40 near the distal end thereof. For example, the additional cylinder is provided at a position near a portion of the ground electrode member 40 where the cut surface 45 is to be formed, and that portion is supported by the distal end of the piston rod of the additional cylinder. That is, the support part 83 may be any structure, so long as the support part 83 can support the ground electrode member 40 so as to prevent defective deformation when the movable blade 60 retracts. Therefore, although not illustrated, the ground electrode member 40 may be supported by the distal end of a push pin which has lock means or a link mechanism which can position the push pin. Even in the case where any of the above-mentioned structures or means is employed, preferably, the support part supports the ground electrode member 40 at a position as close as possible to the cut surface 45 so as to prevent the distal end of the ground electrode member 40 from moving in the step of pulling back the movable blade 60.

Next, a different embodiment (second embodiment) of the present invention will be described with reference to FIGS. 4 to 7. The present embodiment differs from the first embodiment only in that the support part 83 is not provided on the movable blade 60, and control for the stationary blade 50, etc. after the cutting operation slightly differs from that employed in the first embodiment. The cutting apparatus 200 and the cutting step employed in this embodiment are basically the same as those of the first embodiment, except for the arrangement of the support part 83 and its drive means. Therefore, only the difference from the first embodiment will be described. The same portions in the drawings are denoted by the same reference numerals, and their descriptions will not be repeated.

Figure 4:
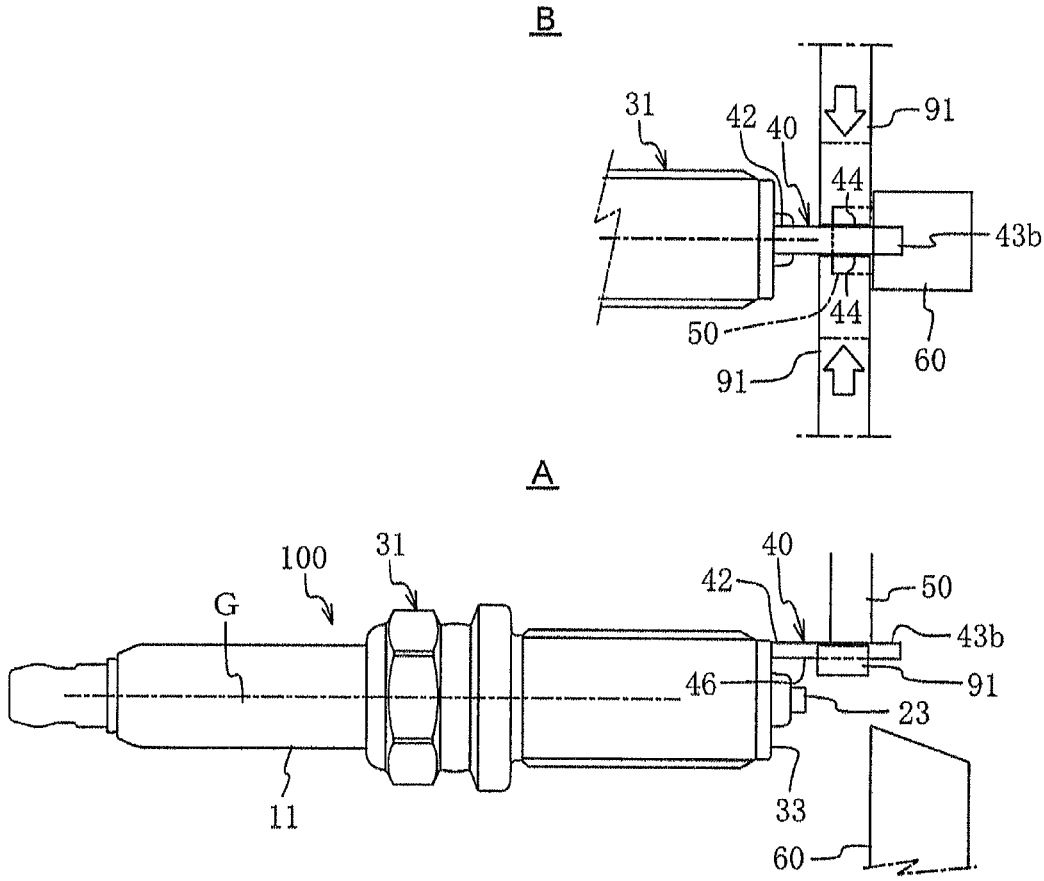
FIG. 4 is an explanatory views showing steps in a second embodiment, where section A is a front view showing a state before entering a cutting step, and section B is a plan view of its main portion.
Figure 5:
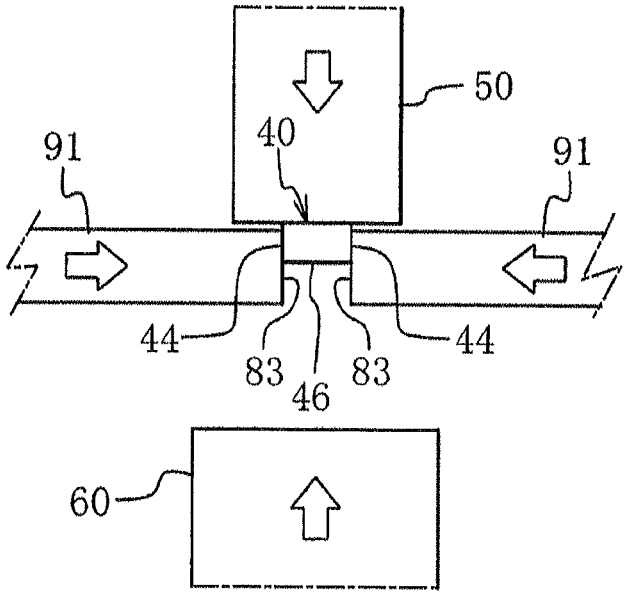
FIG. 5 is an enlarged view mainly showing a distal end portion of a ground electrode member, as viewed from the left side in FIG. 4A.
Figure 6:
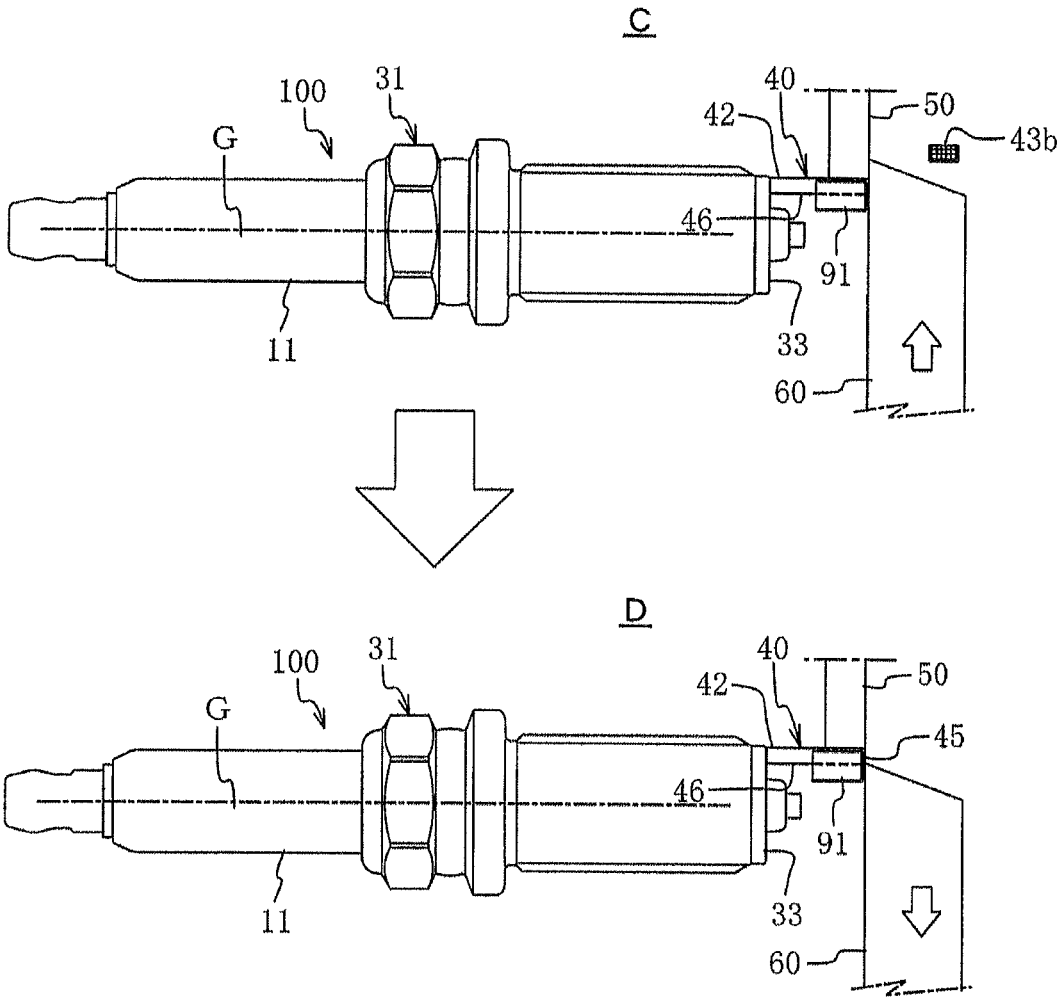
FIG. 6 is an explanatory views showing steps in the second embodiment, where section C is a front view showing a state after the distal end portion of the ground electrode member is cut, and section D is a front view showing a step of pulling back a movable blade after cutting.
Figure 7:
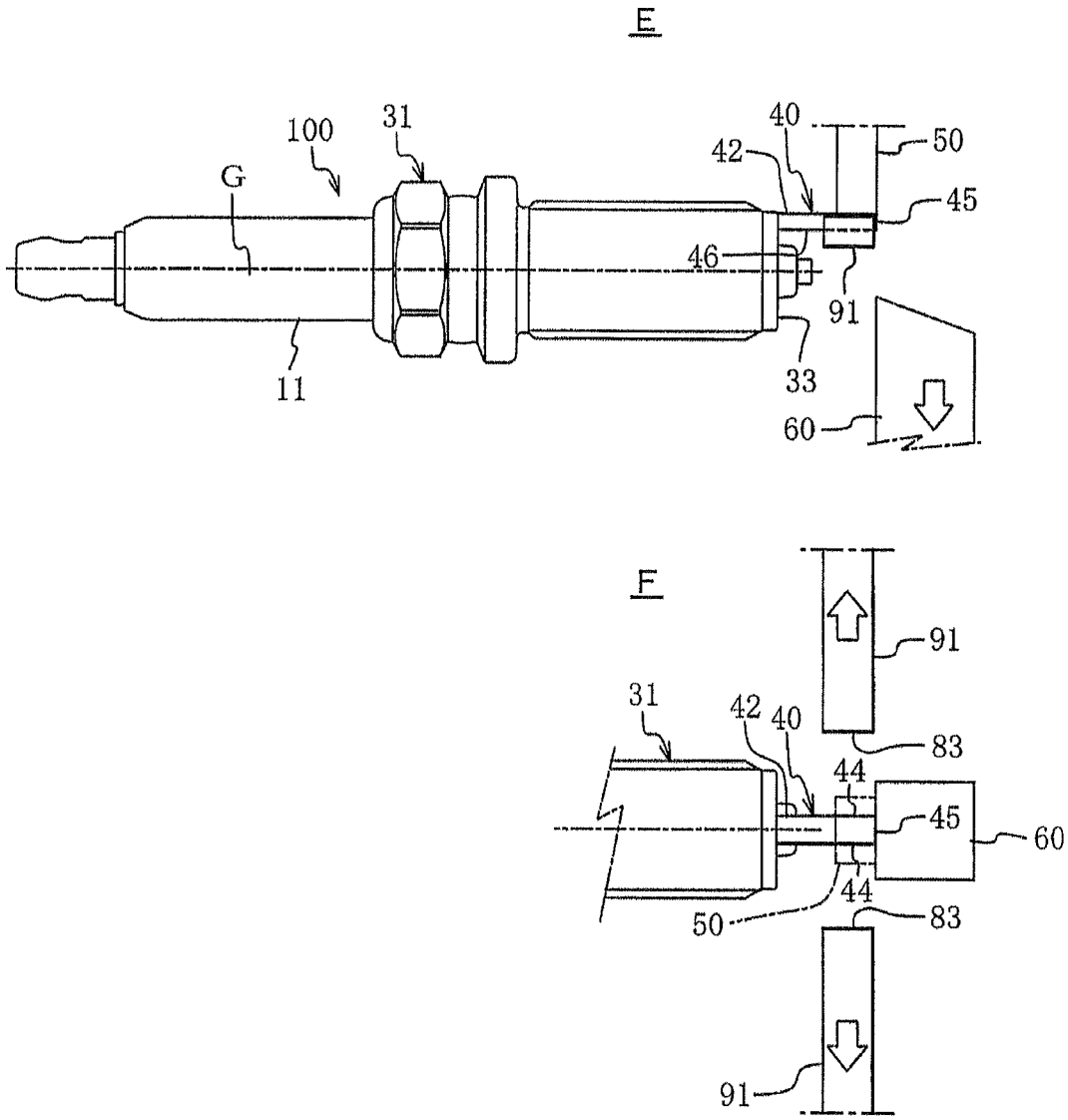
FIG. 7 is an explanatory views showing steps in the second embodiment, where section E is a front view showing a state after the movable blade is pulled back after cutting, and section F is a plan view showing a state after support part for nipping the ground electrode member from both sides are retracted.

That is, in the present embodiment, the cutting apparatus 200 has two support part 83 separately from the movable blade 60. As shown in FIG. 4, for example, in a plan view of the apparatus 200 of FIG. 1 (as viewed from above), the support part 83 advance and retract perpendicular to opposite side surfaces 44 of the rodlike ground electrode member 40. The two support part 83 nip and support the ground electrode member 40 at a position close to the cut surface at the distal end of the ground electrode member 40, via the side surfaces 44 approximately perpendicular to a surface 46 of the ground electrode member 40 facing the axis G of the metallic shell 31. The support part 83, which support the opposite side surfaces 44, are distal ends of push pins 91, which are driven and controlled by unillustrated air cylinders.

In the present embodiment, in the same manner as described in the above-mentioned embodiment, the intermediate 100 is supported by and fixed to the jig 205 on the workpiece support table 207 of the cutting apparatus 200. Subsequently, the stationary blade 50 is positioned in the same manner as described above. After that, the push pins 91 are advanced so as to bring the support part 83 into contact with the two side surfaces 44 of a portion of the ground electrode member 40 near the distal end thereof, to thereby nip the ground electrode member 40 (see FIG. 5). After that, as shown in section C of FIG. 6, in the same manner as in the above-mentioned embodiment, the movable blade 60 is moved upward and fed into the ground electrode member 40 from the surface 46 located on the side toward the axis G of the metallic shell 31, whereby the distal end portion 43*b* of the ground electrode member 40 is cut and removed through shearing. As shown in section D of FIG. 6 and section E of FIG. 7, after the shearing operation (cutting and removing operation), the movable blade 60 is retracted (moved downward) to the original position. In this step of retracting the movable blade 60, there is maintained a state in which the two support part 83 nip a portion of the ground electrode member 40 near the distal end thereof via the two side surfaces 44 thereof. After the movable blade 60 separates from the cut surface 45, the two push pins 91 are retracted so as to cancel their nipping operation. If necessary, the tool slide 251 is moved upward by driving the vertical position adjustment mechanism 241 so as to separate the stationary blade 50 from the cut surface. The intermediate 100 having undergone the cutting operation is taken out from the jig 205, whereby the machining of the intermediate 100 is completed.

That is, in the present embodiment, the ground electrode member 40 is nipped by the two support part 83 via the two side surfaces 44 thereof until the movable blade 60, which is retracted after completion of the cutting operation, separates from the cut surface 45 at the distal end of the ground electrode member 40. Therefore, when the movable blade 60 is pulled back after the cutting operation, the distal end portion of the ground electrode member 40 can be prevented from causing deflective deformation toward the axis G of the metallic shell 31. Notably, movement of the distal end of the ground electrode member 40 in the step of pulling back the movable blade 60 occurs only when after the movable blade 60 is in contact with the distal end of the ground electrode member 40 after the cutting thereof. Therefore, when the contact ends (the movable blade 60 separates from the ground electrode member 40) in the step of retracting the movable blade 60, the operation of nipping the ground electrode member 40 by the support part 83 via the two side surfaces 44 becomes unnecessary. During the period between the start of the operation of cutting the ground electrode member 40 by moving the movable blade 60 upward and the end of the cutting operation before the pull back operation, the distal end of the ground electrode member 40 does not defectively deform toward the axis G of the metallic shell 31. Therefore, the operation of the nipping the ground electrode member 40 by the support part 83 may be performed only when the movable blade 60 maintains contact with the cut surface 45 at the end of the ground electrode member 40 in the step of pulling back (retracting) the movable blade 60 after the cutting operation. However, when the nipping operation is started before the start of the cutting operation as in the above-described embodiment, the position of the ground electrode member 40 during the cutting operation becomes stable, which is preferred.

Notably, in the present embodiment, the ground electrode member 40 is supported via the two side surfaces 44. Therefore, it is possible to prevent formation of a mark on a surface of the ground electrode member 40 which faces the distal end of the center electrode 21 in a completed spark plug, which mark would otherwise be formed because of pressure contact or frictional engagement with the support part 83. In addition, the support part 83 can support the ground electrode member 40 even in the case where, as will be described later, a noble metal tip is joined to or a protrusion is formed on a surface of the distal end, or a portion near the distal end, of the ground electrode member 40, which surface will face the distal and portion of the center electrode 21; that is, will form a gap in cooperation with the distal end of the center electrode 21 after the bending work.

Next, other embodiments (third to fifth embodiments) of the present invention will be described with reference to FIGS. 8 to 12. In the above-described embodiments, the support part 83 supports or nips the ground electrode member 40 so as to restrain (prevent) generation of deflective deformation, which would otherwise be generated when the distal end of the ground electrode member 40 moves in the pull-back direction of the movable blade 60 because of friction generated between the movable blade 60 and the cut surface when the movable blade 60 is pulled back along the cut surface 45 at the distal end of the ground electrode member 40. In contrast, in the third to fifth embodiments, the generation of deflective deformation is prevented by controlling either or both of the movements of the stationary blade 50 and the movable blade 60 without use of the support part 83 (that is, without performing the supporting or nipping operation). However, a cutting apparatus 200 used in these embodiments is identical with the cutting apparatus 200 used in the first embodiment except that the support part 83 is not provided on the movable blade 60. Therefore, the description of the cutting apparatus 200 itself will not be repeated. Also, since the step of fixing the intermediate 100 to the jig 205 to be supported on the workpiece support table 207 of the cutting apparatus 200 and the step of positioning the stationary blade 50 are identical with those in the above-described embodiment, only steps after the step of positioning the stationary blade 50 will be described. Notably, in the third to fifth embodiments, the intermediate (before being subjected to the cutting operation) 100 is configured such that a noble metal tip 47 is joined to or a protrusion 48 is formed on a portion of the ground electrode member 40 which will form a gap in cooperation with the distal end of the center electrode 21 after the bending work.

Figure 8:
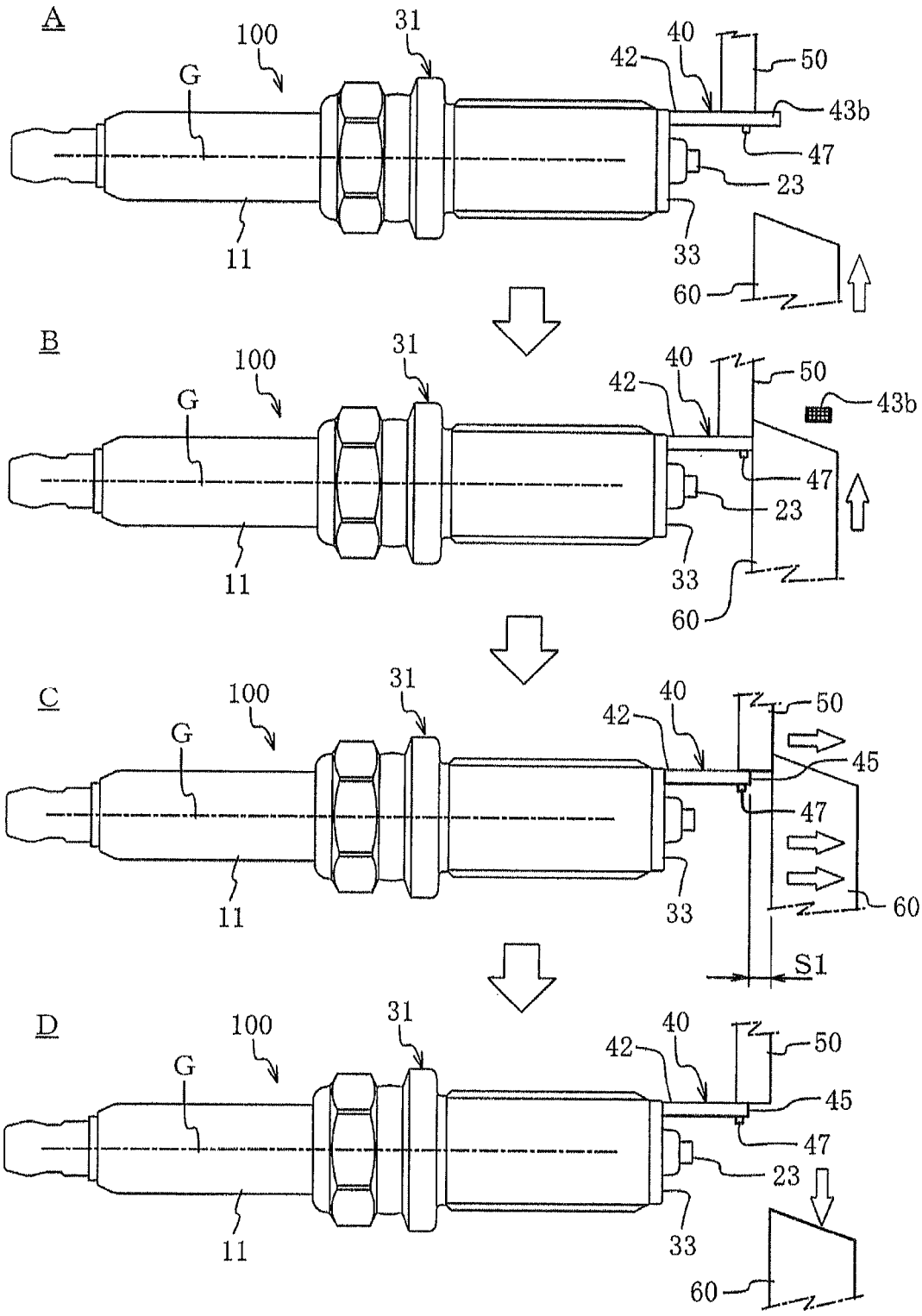
FIG. 8 is an explanatory views showing steps in a third embodiment.

First, the third embodiment will be described with reference to FIG. 8 (see FIGS. 1 and 2). That is, in the present embodiment, in the same manner as described in the above-mentioned first embodiment, the stationary blade 50 is positioned after the intermediate 100 is supported by and fixed to the cutting apparatus 200 (see section A of FIG. 8). After that, as shown in section B of FIG. 8, the movable blade 60 is moved upward through drive of the air cylinder 261 so as to cut and remove the front end portion 43*b*. After that, as shown in section C of FIG. 8, the stationary blade 50 is moved, together with the movable blade 60, by a predetermined amount (moving distance) S1 in a direction away from the cut surface 45 (a direction away from the distal end 33 of the metallic shell 31 along the axis G of the metallic shell 31; rightward in FIG. 8). This movement is effected by moving the tool slide 251 in that direction by driving the horizontal position adjustment mechanism 221 of the cutting apparatus 200 in the first embodiment. After that, as shown in section D of FIG. 8, the movable blade 60 is moved downward to the original position through drive of the air cylinder 261. If necessary, the stationary blade 50 is slightly moved upward, together with the tool slide 251, by driving the vertical position adjustment mechanism 241.

As described above, in the present embodiment, between the cutting step and the pulling-back step, the movable blade 60 is separated by the predetermined amount S1 from the cut surface 45 at the distal end of the ground electrode member 40. Accordingly, since the movable blade 60 is not in contact with the cut surface 45 when the movable blade 60 is pulled back, it is possible to reliably prevent generation of deflective deformation which would otherwise occur when the distal end of the ground electrode member 40 moves in the pull-back direction of the movable blade 60. In the present embodiment, since generation of deflective deformation is prevented by driving and controlling the tool slide 251 or the like in the cutting step, the support part 83 and a mechanism for driving the support part 83 employed in the above-described embodiment are not required. Therefore, the structure of the apparatus can be simplified. Notably, in the present embodiment, the cutting apparatus 200 shown in FIGS. 1 and 2 is used, and both of the movable blade 60 and the stationary blade 50 are mounted on the tool slide 251 so that they are moved together in the horizontal direction. Therefore, the stationary blade 50 is moved simultaneously with the movable blade 60. However, if the movable blade 60 is not in contact with the cut surface 45 at the distal end of the ground electrode member 40 when the movable blade 60 is pulled back, it is possible to prevent generation of deflective deformation which would otherwise occur when the distal end of the ground electrode member 40 moves in the pull-back direction of the movable blade 60.

Figure 9:
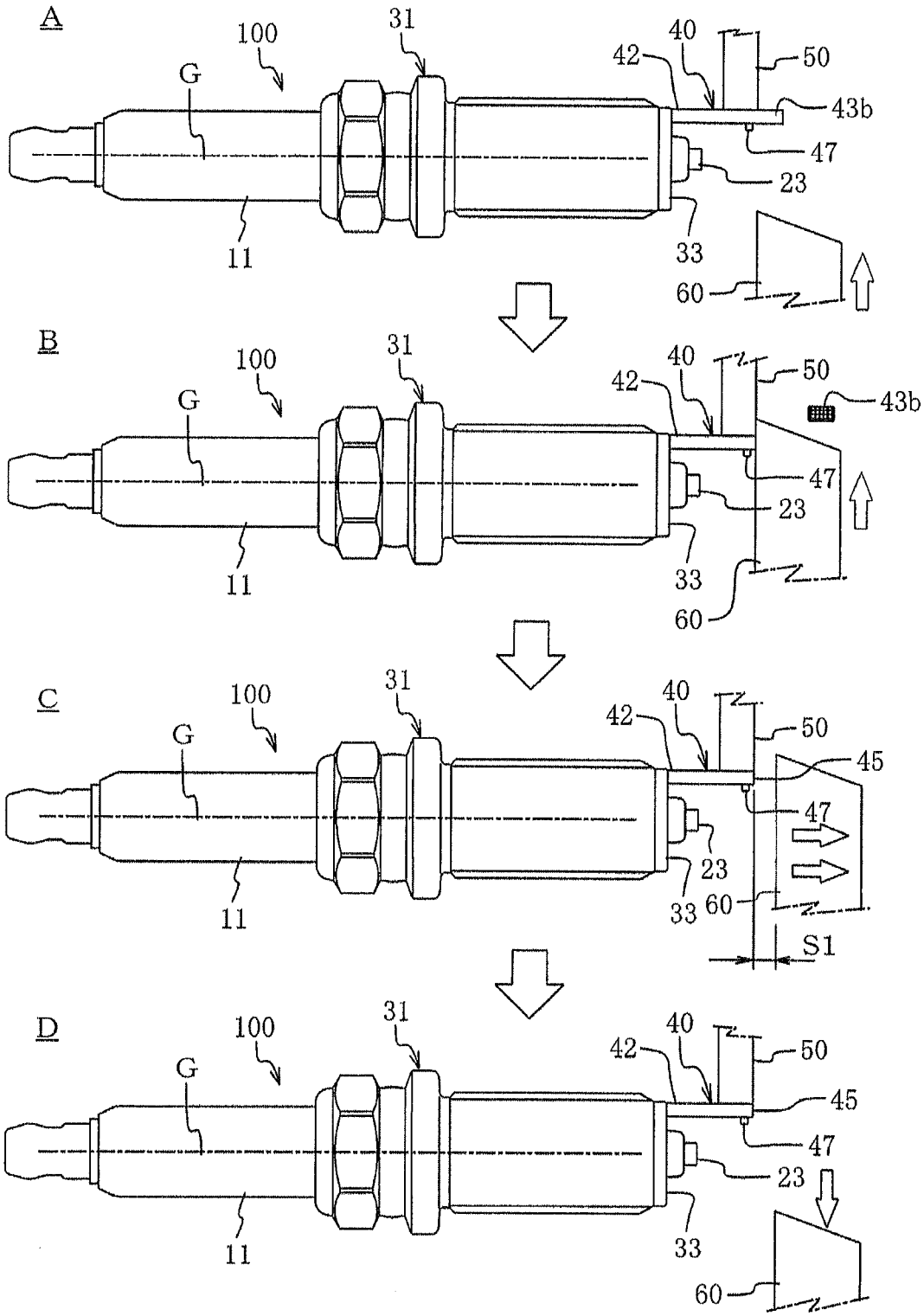
FIG. 9 is an explanatory views showing steps in a fourth embodiment.

Accordingly, although not illustrated in the drawings, the above-mentioned air cylinder 261 may be attached to the tool slide 251 via another horizontal position adjustment mechanism. In this case, as shown in section C of FIG. 9, between the cutting step and the step of pulling back the movable blade 60, only the movable blade 60 can be separated by the predetermined amount S1 from the cut surface 45 at the distal end of the ground electrode member 40. Notably, FIG. 9 shows the fourth embodiment in which a cutting apparatus having such a mechanism is used. The fourth embodiment is a modification of the third embodiment, and includes the steps of positioning the stationary blade 50 after supporting and fixing the intermediate 100 (see section A of FIG. 9), cutting the distal end portion 43*b* as shown in section B of FIG. 9, moving only the movable blade 60 by the predetermined amount S1 in a direction away from the cut surface 45 as shown in section C of FIG. 9, and pulling back the movable blade 60. Since the difference has been described, the detailed description of the fourth embodiment is not provided.

Figure 10:
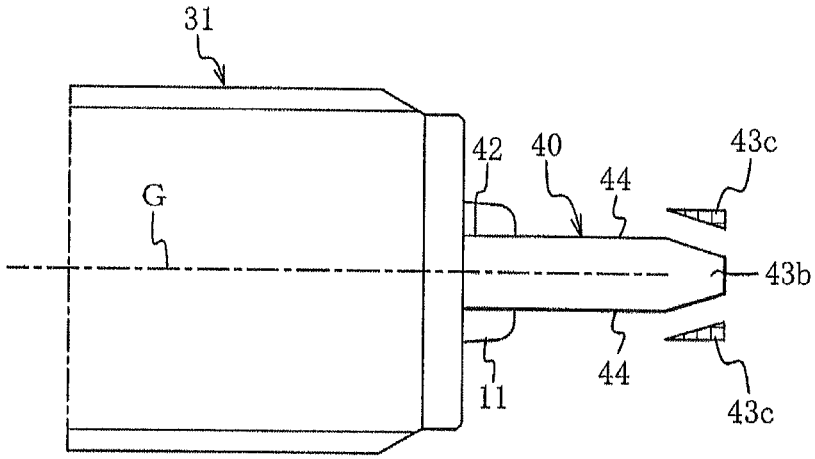
FIG. 10 is an enlarged explanatory view showing an operation of obliquely cutting opposite side surfaces of the distal end portion of the ground electrode member such that the distal end portion has a tapered shape.

Notably, in the third and fourth embodiments, since the support part 83 used in the above-described embodiments (the first and second embodiments) are not required, generation of deflective deformation can be readily prevented not only in the case where the distal end portion of the ground electrode member 40 is cut and removed so that the ground electrode member 40 becomes shorter, but also in the case where, as shown in FIG. 10, the distal end portion of the ground electrode member 40 is sheared such, as viewed from above, that the distal end portion is tapped off; i.e., triangular portions 43*c* are removed from the two side surfaces 44 of the distal end portion. That is, in the case where the distal end portion of the ground electrode member 40 is cut in a state in which the ground electrode member 40 is supported or nipped by the support part 83, the ground electrode member 40 must be supported at a position as close as possible to the expected position of the cut surface potion. In consideration of the sectional dimension (thickness) of the ground electrode member 40, etc., only a little problem may occur when the e ground electrode member 40 is cut such that its length becomes shorter (a length reducing step). However, in the case where, as shown in FIG. 10, the two sides surfaces 44 of the distal end portion 43*b* of the ground electrode member 40 are obliquely cut (an oblique cutting step) such that the distal end portion is tapped off as viewed from the surface which is to face the center electrode 21 after the bending work, there is a restriction on moving the support position (or the nipping position) to a position close to the distal end of the ground electrode member 40. Therefore, when such a support mechanism is employed, the distal end of the ground electrode member 40 projects from the support mechanism. In contrast, in the third and fourth embodiments, such a support (or nipping) mechanism is not employed; therefore, the present invention can be applied, without causing any problem, to the case where the above-mentioned oblique cutting step is performed.

Figure 11:
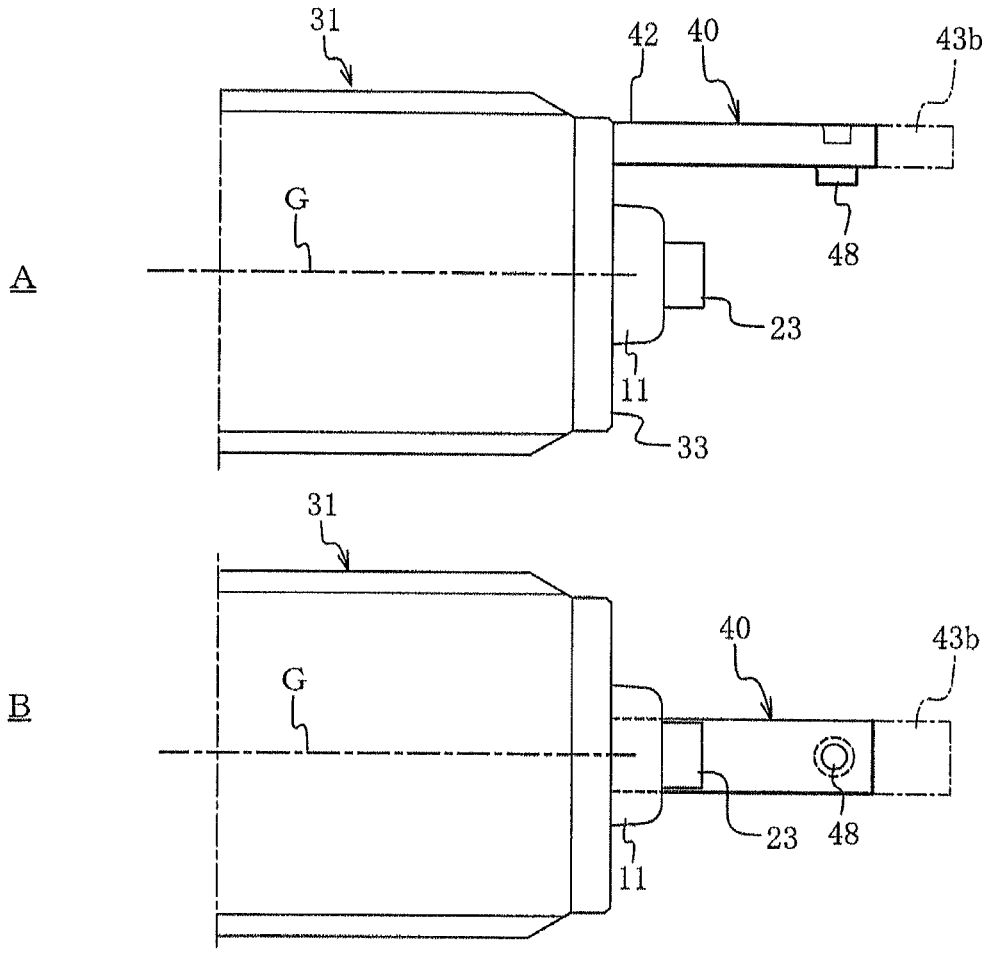
FIG. 11 is an enlarged explanatory views showing a case where a projection is formed on a portion of the ground electrode member near the distal end thereof, the portion forming a gap in cooperation with the distal end of a center electrode after the ground electrode member is bent, wherein section A is a front view, and section B is a view of the ground electrode member as viewed from the axis side.

Notably, in the present embodiment, the intermediate 100 has the noble metal tip 47 joined to the ground electrode member 40. However, the distal end portion 43*b* of the ground electrode member 40 can be cut without causing any problem even in the case where, as shown in FIG. 11, a protrusion 48 is formed on a portion which will form a gap in cooperation with the distal end 23 of the center electrode 21 after the bending work. The same effect can be attained in the case where the ground electrode member 40 is nipped from the two opposite side surfaces as in the case of the above-mentioned second embodiment. Even the first embodiment can cope with the case where the noble metal tip 47 or the protrusion 48 is provided on the ground electrode member 40, through a modification; that is, by providing a recess in the support part (front end surface) 83 of the support block 81 so as to prevent interference with the noble metal tip 47 or the protrusion 48.

Figure 12:
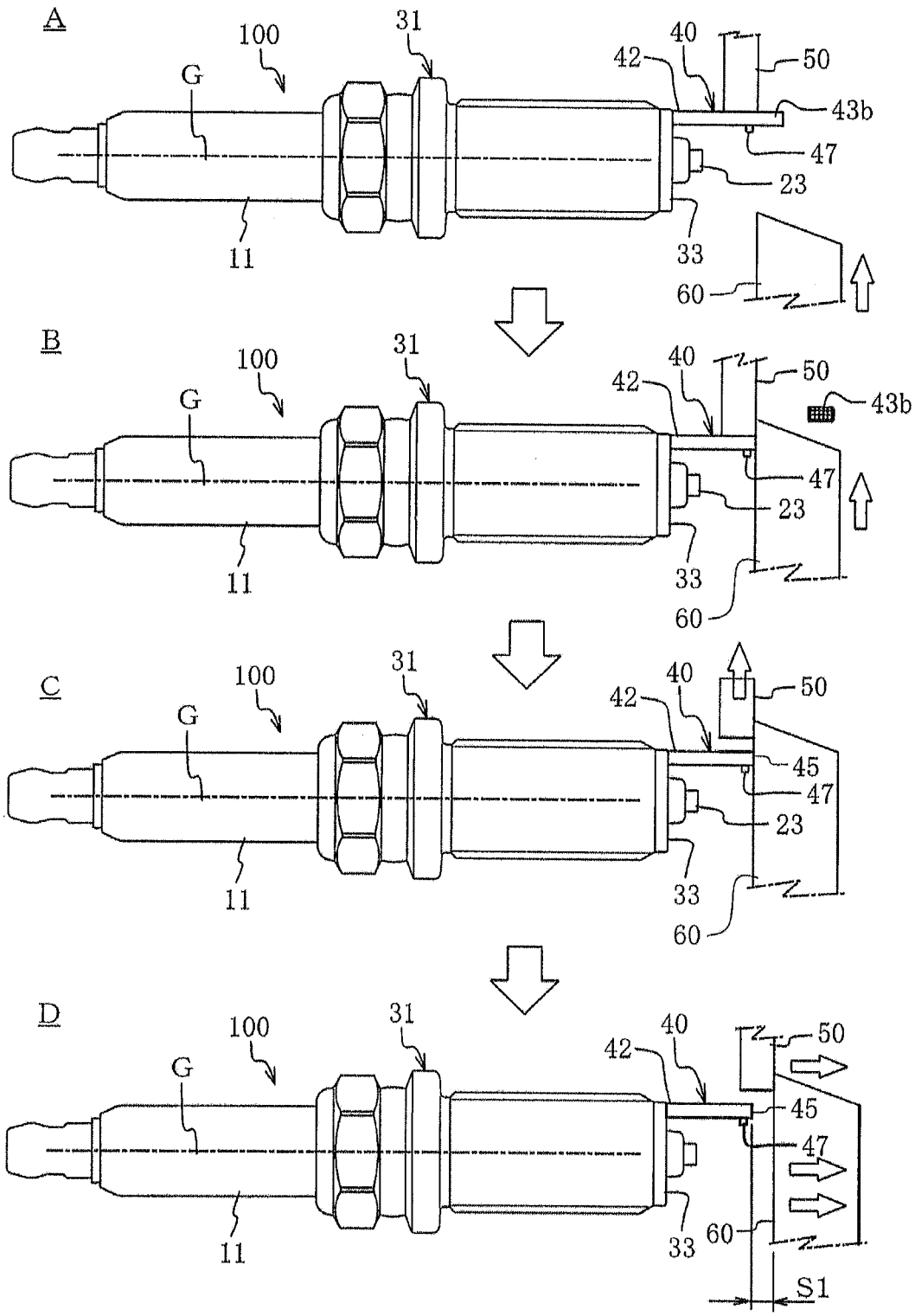
FIG. 12 is an explanatory views showing steps in a fifth embodiment.
Figure 13:
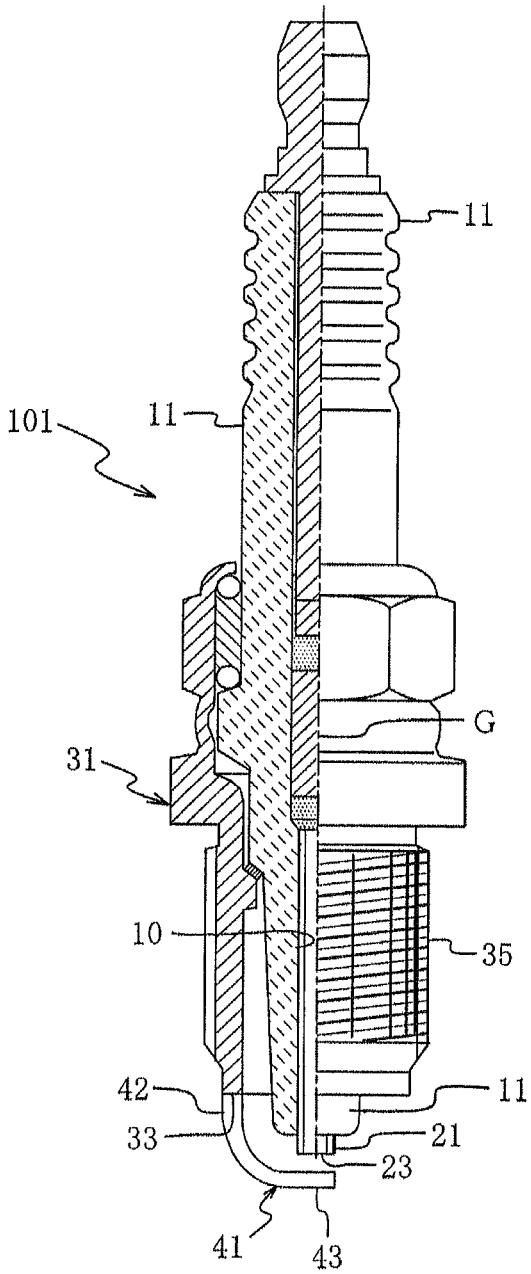
FIG. 13 is a half-sectioned view of a spark plug as longitudinally sectioned.
Figure 14:
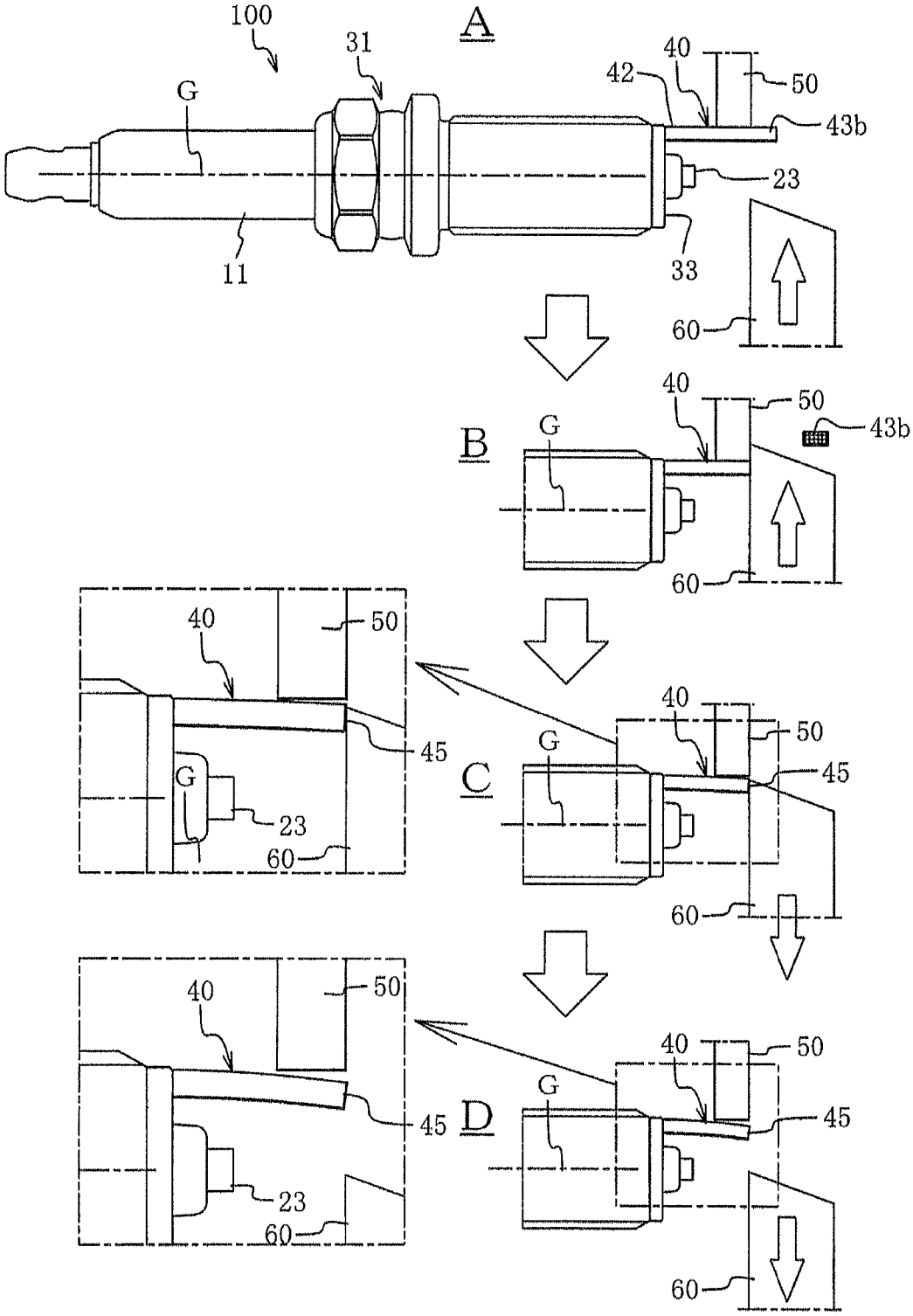
FIG. 14 is an explanatory views showing steps of cutting a distal end portion of a ground electrode member in a conventional method for manufacturing a spark plug.

Next, the fifth embodiment will be described with reference to FIG. 12. In the present embodiment, as shown in section A of FIG. 12, the stationary blade 50 is positioned after the intermediate 100 is supported by and fixed to the cutting apparatus 200. After that, as shown in section B of FIG. 12, the movable blade 60 is moved upward through drive of the air cylinder 261 so as to cut and remove the front end portion 43*b*. After that, as shown in section C of FIG. 12, in order to move the stationary blade 50 in a direction (upward direction in the drawing) away from the surface of the ground electrode member 40 opposite the surface thereof facing the axis G of the metallic shell 31; that is, the surface of the ground electrode member 40 with which the stationary blade 50 has been in contact, the tool slide 251 is slightly moved in that direction through drive of the vertical position adjustment mechanism 241. Since the tool slide 251 is moved, the movable blade 60 is also moved simultaneously with the stationary blade 50 in the same direction. Subsequently, as shown in section D of FIG. 12, in order to move the movable blade 60, together with the stationary blade 50, in a direction away from the cut surface 45 (a direction away from the distal end 33 of the metallic shell 31 along the axis G of the metallic shell 31), the tool slide 251 is slightly moved in that direction through drive of the horizontal position adjustment mechanism 221. After that, although not illustrated in the drawing, the movable blade 60 is moved downward to the original position through drive of the air cylinder 261.

In the present embodiment as well, between the cutting step and the pulling-back step, the movable blade 60 is separated from the cut surface 45 at the distal end of the ground electrode member 40. Accordingly, since the movable blade 60 is not in contact with the cut surface 45 when the movable blade 60 is pulled back, it is possible to reliably prevent generation of deflective deformation which would otherwise occur when the distal end of the ground electrode member 40 moves in the pull-back direction of the movable blade 60. In addition, in the present embodiment, before the stationary blade 50 is moved in the direction away from the cut surface 45 after the cutting step (the movement in the horizontal direction), the stationary blade 50 is moved in the direction away from the surface of the ground electrode member 40 opposite the surface thereof facing the axis G of the metallic shell 31; that is, the surface of the ground electrode member 40 with which the stationary blade 50 has been in contact. Thus, it is possible to prevent the stationary blade 50 from interfering with cutting burrs.

Notably, in the above-described third to fifth embodiments, the distance (horizontal moving distance) S1, by which the movable blade 60 (and the stationary blade 50) is moved in the direction away from the cut surface 45, is preferably set to a distance equal to or greater than the clearance (shearing clearance) between the stationary blade 50 and the movable blade 60 before moving, which clearance is set for the shearing work. Thus, interference with cutting burrs can be prevented effectively. The present invention is not limited to the above-described embodiments, and may be modified as appropriate.

DESCRIPTION OF REFERENCE NUMERALS

21: center electrode
31: metallic shell
33: front end of the metallic shell
40: ground electrode member
41: ground electrode
43*b*: distal end portion of the ground electrode member
44: side surface of the ground electrode member
45: cut surface at the distal end of the ground electrode member
46: surface of the ground electrode member on the side toward the axis of the metallic shell
47: noble metal tip
48: protrusion
50: stationary blade
60: movable blade
83: support part
101: spark plug
G: axis
S1: distance by which the movable blade is moved in a direction away from the cut surface

The invention claimed is:

1. A method for manufacturing a spark plug which includes a center electrode, a metallic shell having a bore extending in a direction of an axis, and a ground electrode disposed at a front end of the metallic shell and formed from a ground electrode member, wherein a step of forming the ground electrode comprises the steps of:

cutting off a distal end portion of the ground electrode member which is provided on the metallic shell through shearing action caused by use of a movable blade, whereby a cut surface is formed at the distal end of the ground electrode member; and disposing at least one support part in a vicinity of the cut surface such that said support part prevents the distal end of the ground electrode member from moving in a direction in which the movable blade is pulled back after the cutting the distal end portion, wherein movement of the distal end would be caused by friction generated between the movable blade and the cut surface but for the support part.

2. The method for manufacturing a spark plug according to claim 1, wherein the support part supports a surface portion of the ground electrode member, said surface portion being located near the cut surface and facing the axis of the metallic shell.

3. The method for manufacturing a spark plug according to claim 1, wherein the support part is in two sections that support two side surfaces of the ground electrode member near the cut surface at the distal end by nipping the side surfaces, said side surfaces being perpendicular to the cut surface and a surface portion facing the axis of the metallic shell.

4. The method for manufacturing a spark plug according to claim 3, wherein a noble metal tip is joined to a portion of the ground electrode member near the distal end thereof, the portion forming a gap in cooperation with a distal end of the center electrode when the ground electrode member is bent.

5. The method for manufacturing a spark plug according to claim 3, wherein a protrusion is formed on a portion of the ground electrode member near the distal end thereof, the portion forming a gap in cooperation with a distal end of the center electrode when the ground electrode member is bent.

6. The method for manufacturing a spark plug according to claim 1, wherein the step of cutting the distal end portion is a length reducing step of cutting the distal end, portion of the ground electrode member through the shearing action such that the length of the ground electrode member becomes shorter.

7. The method for manufacturing a spark plug according to claim 1, wherein the step of cutting the distal end portion is an oblique cutting step of obliquely cutting opposite side surfaces of the distal end portion of the ground electrode member through the shearing action such that the distal end portion is tappered off as viewed from a surface of the distal end portion which is to face the center electrode when the ground electrode member is bent.

8. A method for manufacturing a spark plug which includes a center electrode, a metallic shell having a bore extending in a direction of an axis, and a ground electrode disposed at a front end of the metallic shell and formed from a ground electrode member, wherein a step of forming the ground electrode comprises the steps of:

cutting off a distal end portion of the ground electrode member provided on the metallic shell through shearing action caused by a use of a movable blade, whereby a cut surface is formed at the distal end of the ground electrode member; and moving the movable blade away from the cut surface in a longitudinal direction of the ground electrode after cutting the distal end portion.

9. The method for manufacturing a spark plug according to claim 8, wherein the step of cutting comprises the steps of:

causing the shearing to be performed by use of a stationary blade along with the movable blade in a state in which the stationary blade is in contact with a contact surface of the ground electrode member;

moving the stationary blade in a direction away from the contact surface of the ground electrode member;

moving the movable blade together with the stationary blade in the direction away from contact with the cut surface; and pulling back the movable blade to an original position.

10. The method for manufacturing a spark plug according to claim 9, wherein a distance by which the movable blade is moved in the direction away from the cut surface is equal to or greater than a clearance between the stationary blade and the movable blade before the movable blade and the stationary blade move.

11. The method for manufacturing a spark plug according to claim 9, wherein a distance by which the movable blade is moved in the direction away from the cut surface is equal to or greater than a clearance between the stationary blade and the movable blade before the movable blade and the stationary blade move.

12. The method for manufacturing a spark plug according to claim 8, wherein the step of cutting the distal end portion is a length reducing step of cutting the distal end portion of the ground electrode member through the shearing action such that the length of the ground electrode member becomes shorter.

13. The method for manufacturing a spark plug according to claim 8, wherein the step of cutting the distal end portion is an oblique cutting step of obliquely cutting opposite side surfaces of the distal end portion of the ground electrode member through the shearing action such that the distal end portion is tapered off as viewed from a surface of the distal end portion which is to face the center electrode when the ground electrode member is bent.

14. The method for manufacturing a spark plug according to claim 8, wherein a noble metal tip is joined to a portion of the ground electrode member near the distal end thereof, the portion forming a gap in cooperation with a distal end of the center electrode when the ground electrode member is bent.

15. The method for manufacturing a spark plug according to claim 8, wherein a protrusion is formed on a portion of the ground electrode member near the distal end thereof, the portion forming a gap in cooperation with a distal end of the center electrode when the ground electrode member is bent.

* * * * *